US006142109A

United States Patent [19]

Fukuda et al.

[11] Patent Number: 6,142,109

[45] Date of Patent: Nov. 7, 2000

[54] ANODE DEVICE OF OUTBOARD MOTOR

[75] Inventors: Katsuhiro Fukuda; Tomokazu Hikosaka, both of Hamamatsu, Japan

[73] Assignee: Suzuki Kabushiki Kaisha, Hamamatsu, Japan

[21] Appl. No.: 09/368,170

[22] Filed: Aug. 5, 1999

[30] Foreign Application Priority Data

Aug. 5, 1998 [JP] Japan ..... 10-222031

[51] Int. Cl.[7] ..... F01P 5/14

[52] U.S. Cl. ..... 123/41.15; 440/88

[58] Field of Search ..... 123/41.15, 41.01; 440/88

[56] References Cited

U.S. PATENT DOCUMENTS

| | | | |
|---|---|---|---|
| 4,588,385 | 5/1986 | Suzuki et al. | 440/88 |
| 4,948,384 | 8/1990 | Bland et al. | 440/78 |
| 5,421,756 | 6/1995 | Hayasaka | 440/89 |
| 5,438,963 | 8/1995 | Tsunoda et al. | 123/54.4 |
| 5,524,584 | 6/1996 | Wantanabe | 123/184.38 |
| 5,549,091 | 8/1996 | Tsunoda et al. | 123/476 |
| 5,617,821 | 4/1997 | Tsunoda et al. | 123/195 P |
| 5,803,023 | 9/1998 | Takahashi et al. | 123/41.01 |
| 5,967,112 | 10/1999 | Haga et al. | 123/196 W |

FOREIGN PATENT DOCUMENTS 11-11390 1/1999 Japan .

*Primary Examiner*—Willis R. Wolfe
*Assistant Examiner*—Katrina B. Harris
*Attorney, Agent, or Firm*—Oblon, Spivak, McClelland, Maier & Neustadt, P.C.

[57] ABSTRACT

In an outboard motor, an exhaust passage is formed to a member constituting an engine such as cylinder block and a water jacket for cooling the exhaust passage is formed adjacent to the exhaust passage between the exhaust passage and an outer wall of the engine constituting member. The outboard motor is further provided with an anode device which comprises an anode mounting port formed to the cylinder block as the engine constituting member so as to penetrate the outer wall thereof and opened to the water jacket, an anode holder detachably mounted to the anode mounting port so as to close the anode mounting port, and an anode mounted to a portion of the anode holder on the side of the anode mounting port.

7 Claims, 7 Drawing Sheets

ANODE DEVICE OF OUTBOARD MOTOR

BACKGROUND OF THE INVENTION

The present invention relates to an anode device of an outboard motor having an improved anode mounting structure.

An outboard motor is provided with an engine having various metal portions or parts, such as cooling water passage, which contact the sea water (brine). Such metal portion may be dissolved into the sea water through the contact thereto and, hence, corrode. This is because the outboard motor is provided with various metal portions or parts formed of different materials, and according to such material difference, an electric potential difference will be caused therebetween. Particularly, a cylinder block of an engine includes a main portion formed of an aluminium alloy, which is liable to easily corrode in comparison with other portions.

In order to obviate such defect, in an actual structure of the outboard motor, a metal such as zinc (Zn) having a potential lower than that of the aluminium alloy is provided at a portion of the outboard motor contacting the sea water or positioned below the sea water level at a time when a hull mounted with the outboard motor is placed on the sea water, such metal being called "sacrifice metal or sacrifice anode" (hereinafter merely called "anode"), thereby preventing the metal portions such as cylinder block of the engine from corroding.

Such anode is mounted to a portion near a cooling water take-in port or a lower case which is disposed below the sea water level such as disclosed in Japanese Patent Laid-open Publication Nos. HEI 6-219387 and HEI 8-48289. Further, in recent years, there is provided a structure in which the anode is accommodated in a water jacket for cooling a cylinder formed to the cylinder block because the solubility of the anode is degraded at an occasion that the sea water surrounding the anode has a low temperature.

However, in an arrangement that the anode is accommodated in the water jacket for cooling the cylinder formed to the cylinder block, it is obliged to dismount the engine to remove a cylinder head every time for inspecting or exchanging the anode, providing a troublesome problem and requiring dismounting cost.

Furthermore, in the arrangement in the water jacket, there is a fear of disturbing or obstructing the flow of the cooling water.

SUMMARY OF THE INVENTION

An object of the present invention is to substantially eliminate defects or drawbacks encountered in the prior art mentioned above and to provide an anode device of an outboard motor having an improved anode mounting structure capable of being easily inspected or exchanged.

Another object of the present invention is to provide an anode device having an improved anode mounting structure mounted thereto without disturbing the flow of the cooling water for the engine.

These and other objects can be achieved according to the present invention by providing an anode device of an outboard motor in which an exhaust passage is formed to a member constituting an engine of an outboard motor and a water jacket for cooling the exhaust passage is formed adjacent to the exhaust passage between the exhaust passage and an outer wall of the engine constituting member, the anode device comprising:

an anode mounting port formed to the engine constituting member so as to penetrate the outer wall thereof and opened to the water jacket;

an anode holder detachably mounted to the anode mounting port so as to close the anode mounting port; and an anode mounted to a portion of the anode holder on the side of the anode mounting port.

In a preferred embodiment, the anode mounted to the anode holder on the side of the anode mounting port has an inside end face positioned inside a surface of an inner wall defining the water jacket.

The anode holder is a lid member for closing the anode mounting port.

The anode holder is secured to the anode mounting port by means of bolt. In an alternation, the anode holder has an inner portion to which thread is formed and the anode mounting port has an outer portion to which thread is formed, these threads being meshed with each other when the anode holder is mounted to the anode mounting port.

The anode is made of a metal having an electric potential lower than that of the engine constituting member. Preferably, the engine constituting member may be a cylinder block of an engine of the outboard motor and the metal forming the anode is zinc as a sacrifice metal having an electric potential lower than an aluminium alloy constituting the cylinder block.

According to the structure that the anode device is detachably mounted to the outer wall of the cylinder block, the anode can be inspected or exchanged without disassembling the engine. Furthermore, since the anode is exposed to the cooling water passing through the water jacket for cooling the exhaust passage at a portion near the outer wall of the cylinder block, the solubility of the anode is improved thereby to perform its function as sacrifice anode.

Still furthermore, the inner end surface of the anode is disposed inside the anode mounting port so as not project into the water jacket, so that the anode does not disturb the cooling water flow in the water jacket. In addition, the anode is itself positioned in a gentle flow of the cooling water having high temperature, so that the anode in the cooling water becomes soluble and adequately perform its function.

The nature and further characteristic features of the present invention will be made more clear from the following descriptions made with reference to the accompanying drawings.

DESCRIPTION OF THE PREFERRED EMBODIMENTS

A first embodiment of the present invention will be described hereunder with reference to FIGS. 1 to 6.

Figure 1:
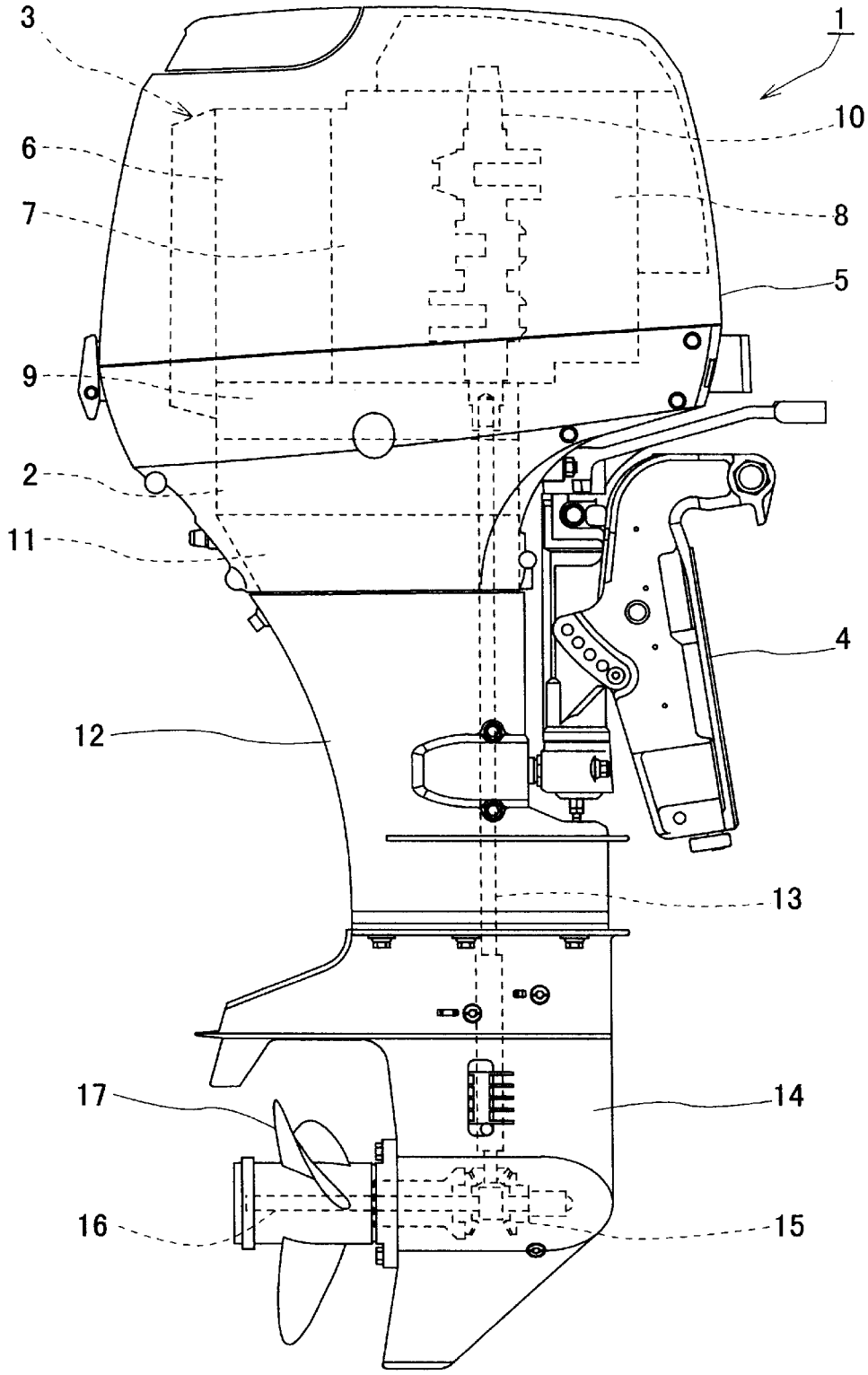
FIG. 1 is a right side view of an outboard motor provided with an anode mounting structure according to a first embodiment of the present invention.

First, with reference to FIG. 1, an outboard motor 1 is in a state of being mounted to a hull, for example, and is provided with an engine holder 2 and an engine 3 disposed above the engine holder 2. A bracket 4 is mounted to the engine holder 2, and the outboard motor 1 is mounted to a transom of a hull, not shown, through the bracket 4. The engine 3 is covered by an outboard motor cover 5, and FIG. 2 is a state that the outboard motor cover 5 is removed from the state of FIG. 1.

Figure 2:
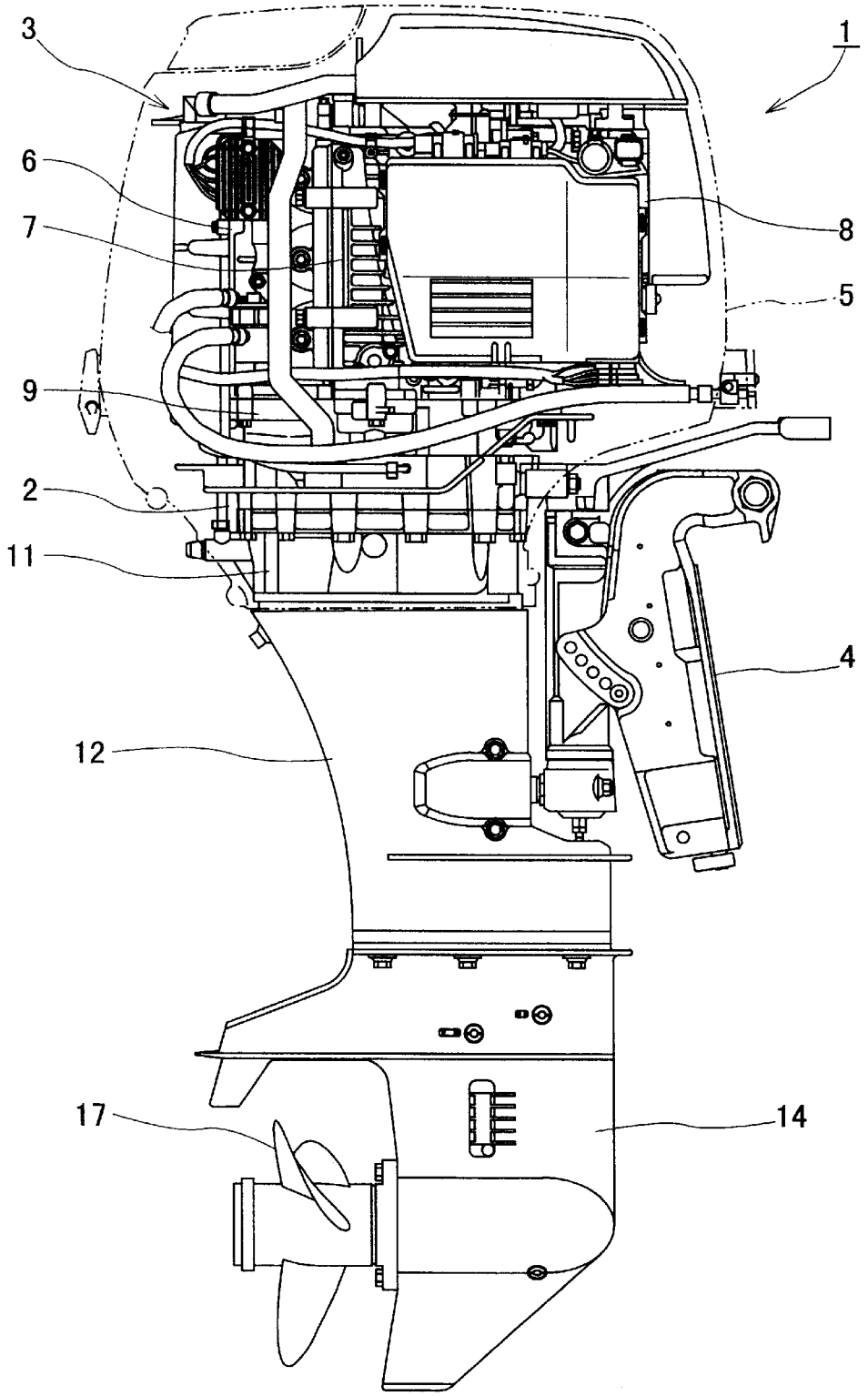
FIG. 2 is a right side view of the outboard motor of FIG. 1 in a state of an outboard motor cover being removed.

Referring to FIGS. 1 and 2, the engine 3 mounted to the shown outboard motor 1 is, for example, a water-cooled four-stroke-cycle three-cylinder engine, which is composed of a cylinder head 6, a cylinder block 7, a crank case 8 and so on constituting an engine unit in assembly, and the engine 3 is disposed above the engine holder 2 through a cam chain case 9.

The cylinder block 7 is, for example, made through an aluminum die cast and is arranged at a rear side (left side as viewed) of the crank case 8 disposed at a right side portion in FIG. 2. The cylinder head 6 is disposed at a rear side of the cylinder block 7. A crank shaft 10 is disposed perpendicularly in a mating portion between the crank case 8 and the cylinder block 7 as shown in FIG. 1, and an oil pan 11 is also arranged at lower portion of the engine holder 2.

A shaft housing 12 is arranged below the oil pan 11, and an upper end portion of a drive shaft 13 is coupled to the lower end portion of the crank shaft 10 through, for example, a spline engagement, the drive shaft 13 extending downward through an inside portion of the shaft housing 12. The lower end portion of the drive shaft 13 extends into a gear case 14 disposed below the shaft housing. Accordingly, the rotation of the crank shaft 10 is transmitted to a gear arrangement, including a bevel gear 15 and a propeller shaft 16, in the gear case 14 through the drive shaft 13, and a propeller 17 connected to the propeller shaft 16 is hence driven.

Figure 3:
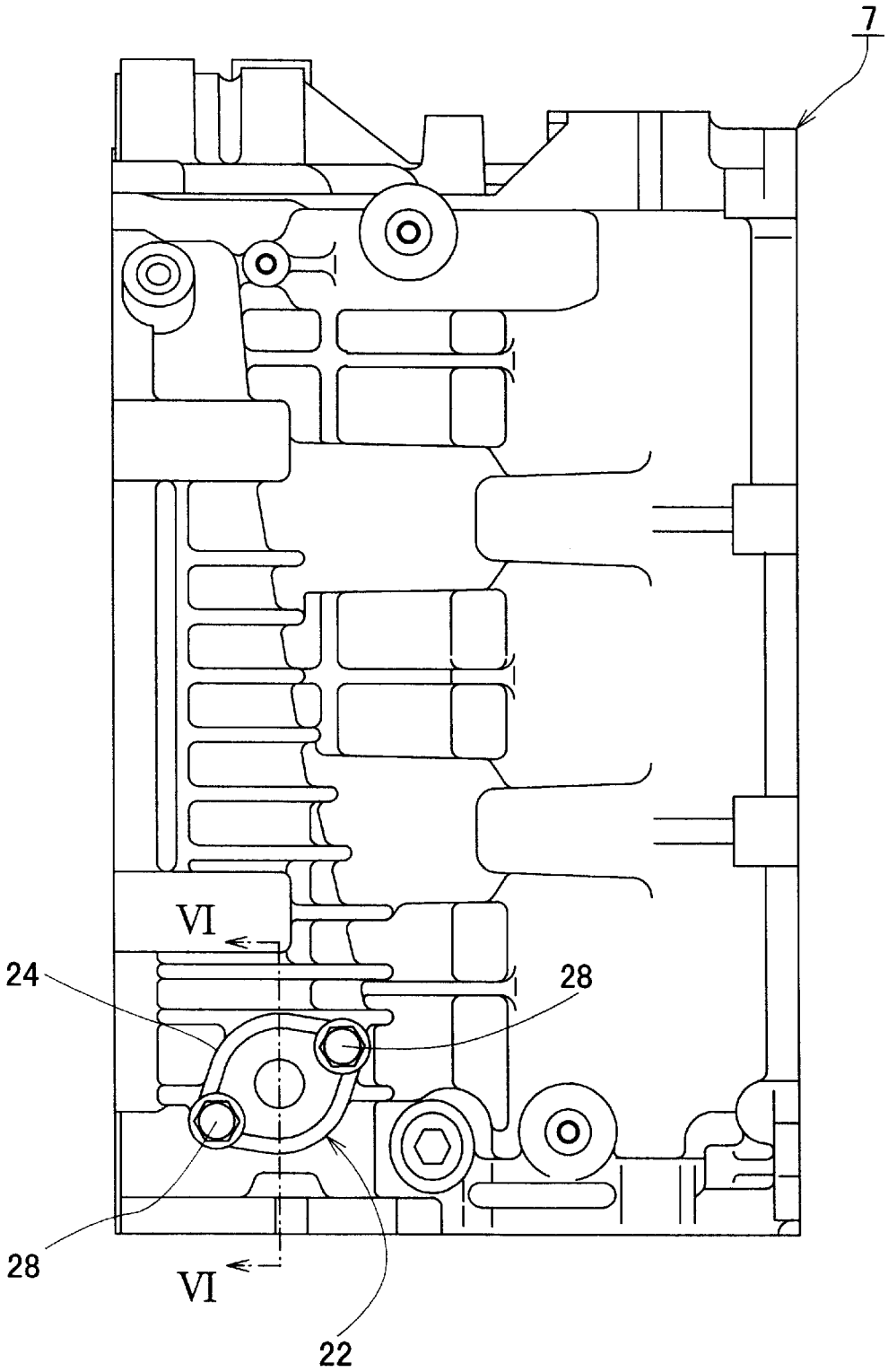
FIG. 3 is a right side view of a cylinder block of an engine of the outboard motor.
Figure 4:
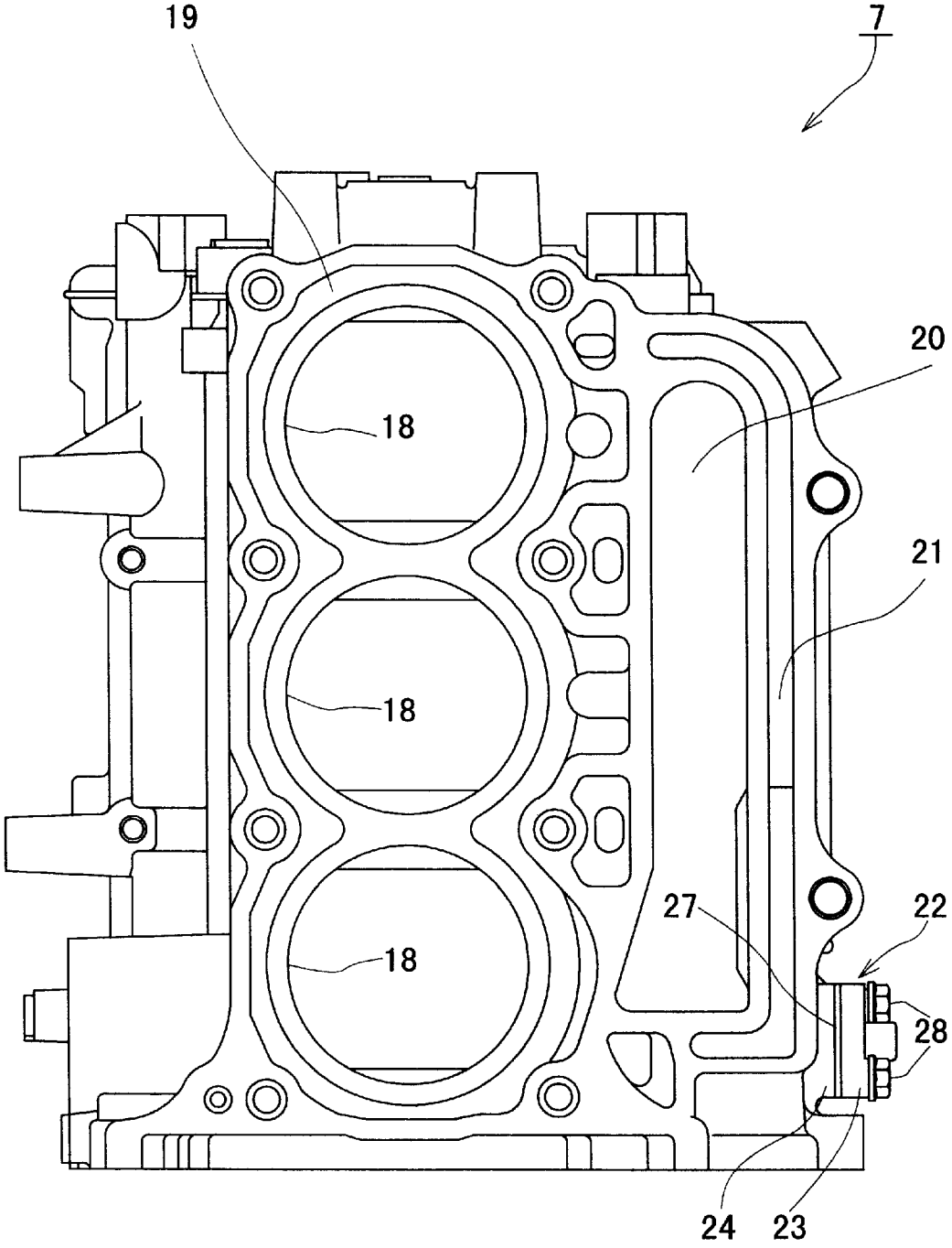
FIG. 4 is a back side view of the cylinder block.
Figure 5:
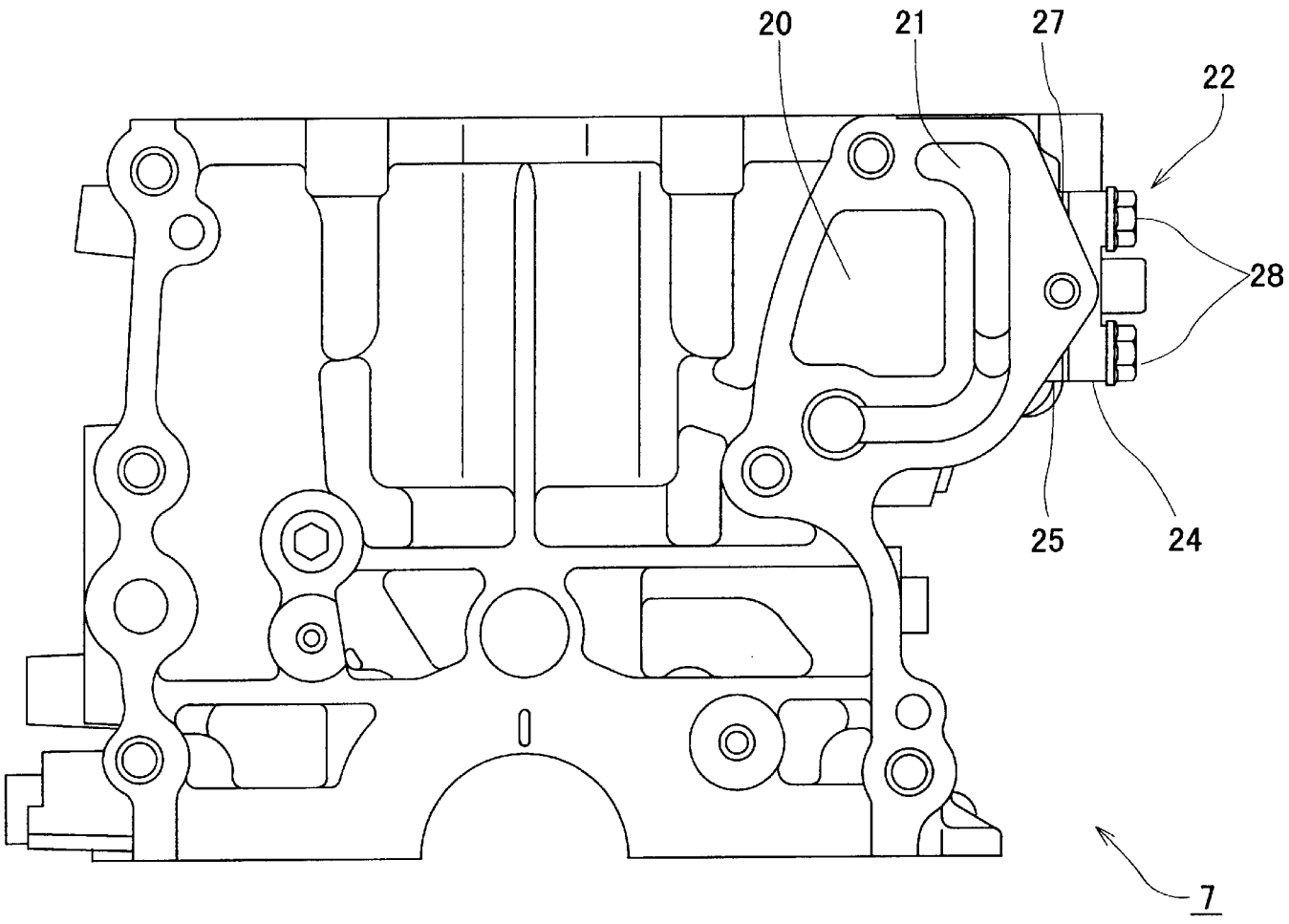
FIG. 5 is a bottom view of the cylinder block.

FIG. 3 is an enlarged right side view of the cylinder block, FIG. 4 shows a mating portion of the cylinder block 7 and the cylinder head 6 and FIG. 5 shows a mating portion of the cylinder block 7 and the cam chain case 9. With reference to FIGS. 3 to 5, cylinders 18 are arranged in the cylinder block 7 formed, for example, through an aluminium die cast process, and a water jacket 19 is formed around the cylinders 18 for cooling the cylinders; 18. As shown in FIG. 4, the cylinder block 7 is formed with an exhaust passage 20 integrally formed, for example, between the cylinders 18 and a right side outer wall of the cylinder block 7, and a further water jacket 21 for cooling the exhaust passage 20 is formed between the exhaust passage 20 and the right side outer wall of the cylinder block 7.

Figure 6:
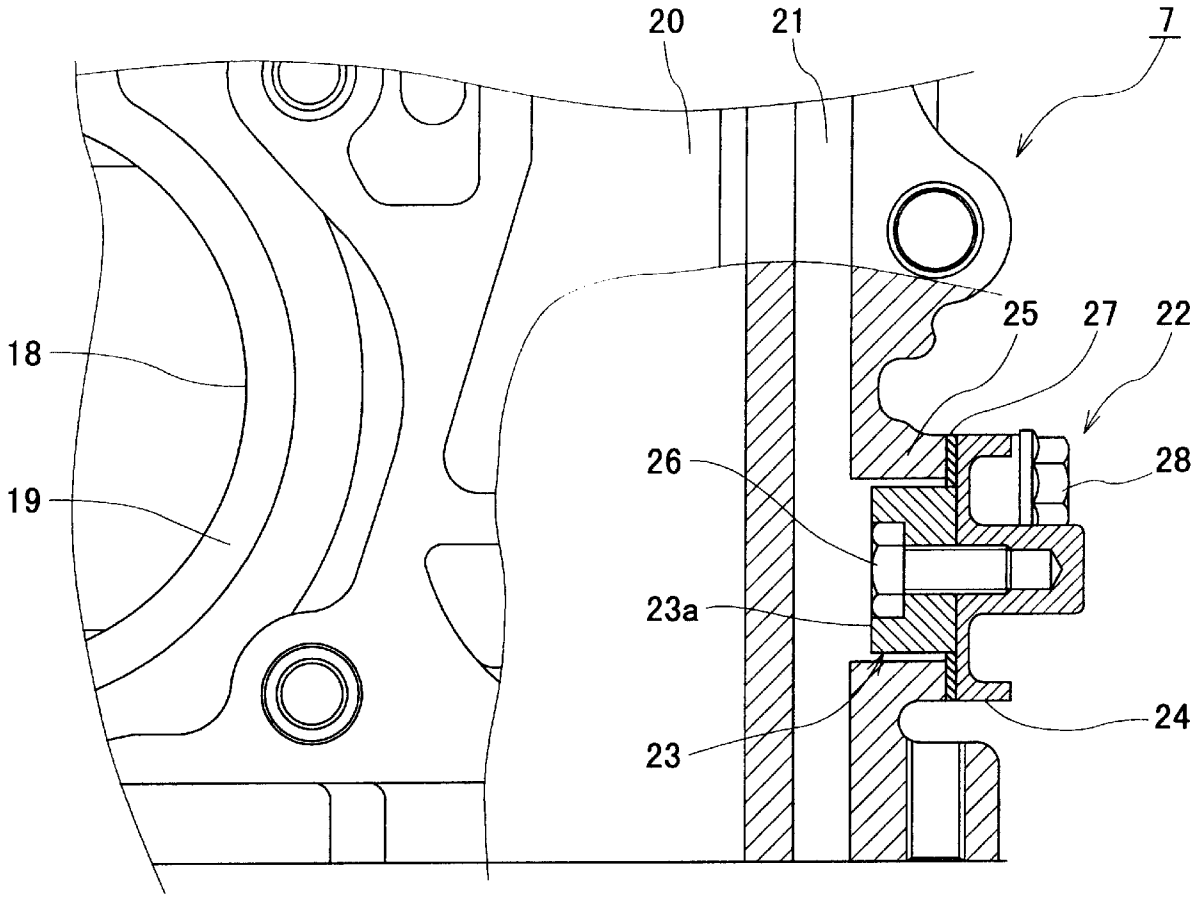
FIG. 6 is a sectional view taken along the line VI—VI in FIG. 3.

With further reference to FIG. 6 taken along the line VI—VI of FIG. 3, the cylinder block 7 is mounted with an anode device 22 which is generally composed of: an anode 23, as sacrifice metal (protection metal) or sacrifice anode, made of metal material such as zinc, for example, having a potential lower than that of an aluminium alloy which is used for forming the cylinder block 7; an anode holder 24 for holding the anode member 23; and an anode mounting portion in shape of port 25.

The anode mounting port 25 is formed to the right side outer wall of cylinder block 7, as viewed, disposed in the vicinity of the water jacket 21 for cooling the exhaust passage. The anode mounting port 25 is formed so as to penetrate the outer wall and reaches the water jacket 21, and the anode mounting port 25 is closed by the anode holder 24 also acting as a cover member.

The anode 23 is disposed inside the anode mounting port 25, and for example, is integrally secured to the inside portion of the anode holder 24 by means of a bolt 26. In this mounting, the anode 23 is mounted in a manner such that the end face 23*a* of the anode 23 does not project into the water jacket 21 and is positioned inside the inner wall of the water jacket 21, as shown in FIG. 6.

The anode holder 24, to which the anode 23 is mounted, is detachably fixed by fastening means of such as bolt 28, for example, so as to close the anode mounting port 25 through a seal member 27.

Figure 7:
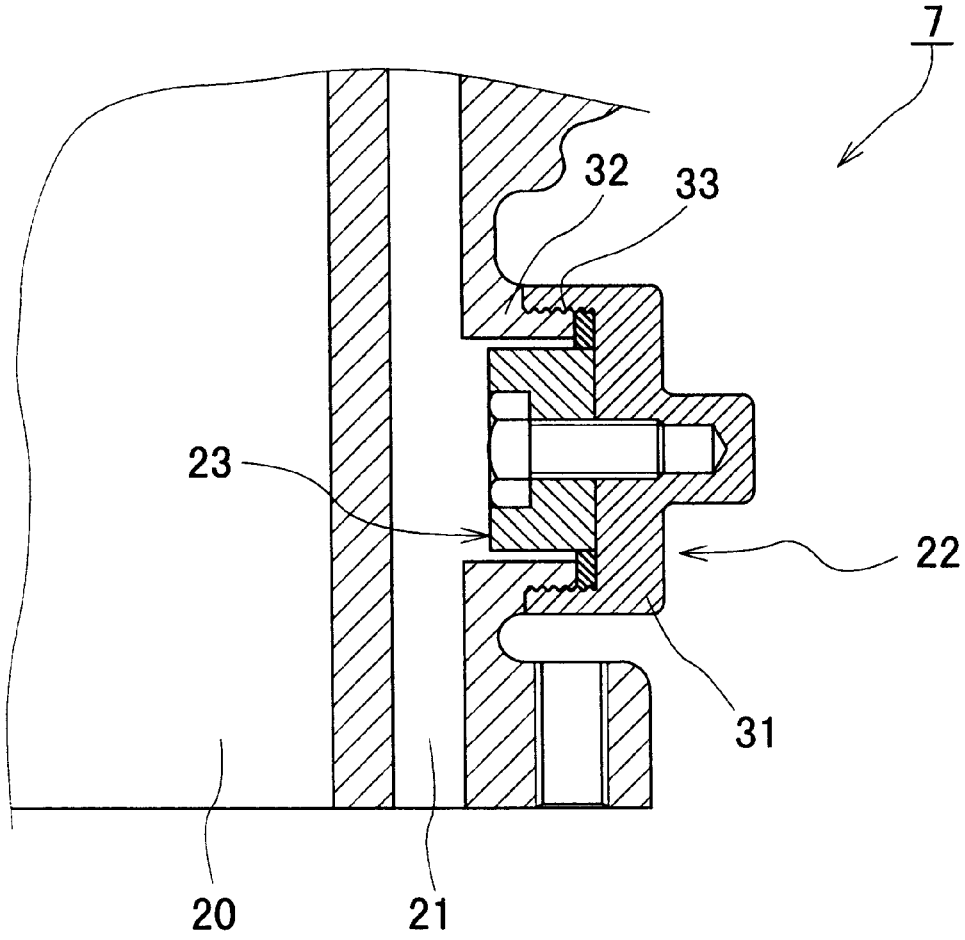
FIG. 7 is an anode mounting structure of a second embodiment of the present invention.

In the second embodiment shown in FIG. 7, as an alternation of the above arrangement, an anode holder 31 is formed in form of a cap having an inner portion to which thread 33 is formed and an anode mounting port 32 is formed in a cylindrical shape having an outer peripheral portion to which thread 33 is formed, both the treads 33 being formed as male and female threads to be screw engaged with each other when the anode holder 31 is applied and mounted to the anode mounting port 32, and in this alternation, the bolt 28 or the like fastening member in the first embodiment can be eliminated.

According to the structure that the anode device 22 is detachably mounted to the outer wall of the cylinder block 7, the anode 23 can be inspected or exchanged without disassembling the engine 3. Furthermore, since the anode is exposed to the cooling water passing through the water jacket 21 for cooling the exhaust passage at a portion near the outer wall of the cylinder block, the solubility of the anode 23 is improved and the anode 23 can hence perform its function as sacrifice anode.

Still furthermore, the inner end surface of the anode 23 is disposed inside the anode mounting port 25 so as not project into the water jacket 21, that is, the inner end surface thereof is positioned inside the inner wall surface of the water jacket 21, so that the anode 23 does not disturb the cooling water flow in the water jacket 21. In addition, the anode 23 is itself positioned in a gentle flow of the cooling water having high temperature, so that the anode in the cooling water becomes soluble and adequately perform its function.

It is to be noted that the present invention is not limited to the described embodiments and many other changes and modifications may be made without departing from the scopes of the appended claims.

What is claimed is:

1. An anode device of an outboard motor in which an exhaust passage is formed to a member constituting an engine of the outboard motor and a water jacket for cooling the exhaust passage is formed adjacent to the exhaust passage between the exhaust passage and an outer wall of the engine constituting member, said anode device comprising:

an anode mounting port formed to the engine constituting member so as to penetrate the outer wall thereof and opened to the water jacket;

an anode holder detachably mounted to the anode mounting port so as to close the anode mounting port; and an anode mounted to a portion of the anode holder on the side of the anode mounting port, said anode having an inside end face positioned inside a surface of an inner wall defining the water jacket.

2. An anode device according to claim 1, wherein said anode holder is a lid member for closing the anode mounting port.

3. An anode device according to claim 1, wherein said anode holder is secured to the anode mounting port by means of a bolt.

4. An anode device according to claim 1, wherein:

said anode holder has an inner portion to which thread is formed; and said anode mounting port has an outer portion to which thread is formed, said threads being meshed with each other when said anode holder is mounted to the anode mounting port.

5. An anode device according to claim 1, wherein said anode is made of a metal having an electric potential lower than that of the engine constituting member.

6. An anode device according to claim 5, wherein:

said engine constituting member is a cylinder block of the engine; and said metal forming the anode is zinc as a sacrifice metal having an electric potential lower than an aluminum alloy constituting the cylinder block.

7. An anode device of an outboard motor, comprising:

an anode mounting port formed in an engine constituting member constituting an engine of the outboard motor, said anode mounting port penetrating an outer wall of the engine constituting member and opened to a water jacket which is formed adjacent to an exhaust passage of the engine and which is positioned between the exhaust passage and the outer wall of the engine constituting member to cool the exhaust passage;

an anode holder detachably mounted to said anode mounting port to close said anode mounting port; and an anode detachably mounted to said anode holder to be positioned inside said anode mounting port such that said anode does not project beyond a surface of an inner wall defining the water jacket.

* * * * *